US011460194B2

(12) United States Patent
Hong et al.

(10) Patent No.: US 11,460,194 B2
(45) Date of Patent: Oct. 4, 2022

(54) COOKING APPLIANCE

(71) Applicant: Samsung Electronics Co., Ltd, Suwon-si (KR)

(72) Inventors: Ji Yea Hong, Suwon-si (KR); Gong Soo Kim, Suwon-si (KR); Hee Jin Yoon, Hwaseong-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 550 days.

(21) Appl. No.: 16/473,225

(22) PCT Filed: Dec. 4, 2017

(86) PCT No.: PCT/KR2017/014054
§ 371 (c)(1),
(2) Date: Jun. 24, 2019

(87) PCT Pub. No.: WO2018/117479
PCT Pub. Date: Jun. 28, 2018

(65) Prior Publication Data

US 2019/0353352 A1 Nov. 21, 2019

(30) Foreign Application Priority Data

Dec. 23, 2016 (KR) ..... 10-2016-0178617

(51) Int. Cl.
*F24C 15/02* (2006.01)
*E05D 3/02* (2006.01)
(Continued)

(52) U.S. Cl.
CPC ..... *F24C 15/021* (2013.01); *E05D 3/02* (2013.01); *E05D 5/06* (2013.01); *E05F 5/02* (2013.01);
(Continued)

(58) Field of Classification Search
CPC ..... F24C 15/021; F24C 15/04; E05D 3/02; E05D 5/06; H05B 6/64; H05B 6/6414; E05F 5/02
See application file for complete search history.

(56) References Cited

U.S. PATENT DOCUMENTS 367,742 A * 8/1887 Byrne
3,785,006 A * 1/1974 Metz ..... E05F 1/1284 16/293
(Continued)

FOREIGN PATENT DOCUMENTS

JP 10-220093 A 8/1998
KR 10-2008-0082848 A 9/2009
(Continued)

OTHER PUBLICATIONS

International Search Report dated Mar. 21, 2018 in connection with International Patent Application No. PCT/KR2017/014054, 2 pages.
(Continued)

*Primary Examiner* — James O Hansen

(57) ABSTRACT

The disclosure relates to a cooking appliance capable of reducing noise generated when a door is closed using a buffer member that is easily fixed to a hinge unit. The cooking appliance includes a main body, a cooking chamber provided to have a front surface opened inside the main body, a door to open and close the cooking chamber, a hinge unit coupled to the main body to rotatably support the door, and a buffer member fixed to the door to buffer an impact generated when the door is closed by contacting the hinge unit when the door is closed.

8 Claims, 13 Drawing Sheets

(51) Int. Cl.

| | |
|---|---|
| ***E05D 5/06*** | (2006.01) |
| ***E05F 5/02*** | (2006.01) |
| ***F24C 15/04*** | (2006.01) |
| ***H05B 6/64*** | (2006.01) |

(52) U.S. Cl.
CPC ..... *F24C 15/04* (2013.01); *H05B 6/64* (2013.01); *H05B 6/6414* (2013.01); *E05Y 2900/308* (2013.01)

(56) References Cited

U.S. PATENT DOCUMENTS

| | | | | |
|---|---|---|---|---|
| 4,940,869 | A * | 7/1990 | Scholtes | H05B 6/6485 219/400 |
| 6,530,122 | B1 | 3/2003 | Kondou et al. | |
| 8,678,486 | B2 * | 3/2014 | Chaufour | F16F 1/373 16/374 |
| 2017/0082296 | A1 * | 3/2017 | Jeong | F24C 15/28 |

FOREIGN PATENT DOCUMENTS

| | | | |
|---|---|---|---|
| KR | 10-2009-0099813 | A | 9/2009 |
| KR | 10-2009-0010611 | U | 10/2009 |
| KR | 10-2011-0045970 | A | 5/2011 |

OTHER PUBLICATIONS

Written Opinion of the International Searching Authority dated Mar. 21, 2018 in connection with International Patent Application No. PCT/KR2017/014054, 5 pages.

* cited by examiner

COOKING APPLIANCE

CROSS-REFERENCE TO RELATED APPLICATIONS

The present application is a 371 National Stage of International Application No. PCT/KR2017/014054 filed on Dec. 4, 2017, which claims the benefit of Korean Patent Application No. 10-2016-0178617 filed on Dec. 23, 2016, the contents of which are incorporated herein by reference.

BACKGROUND

1. Field

The disclosure relates to a cooking appliance capable of reducing noise generated when a door is closed.

2. Description of Related Art

Generally, a microwave oven is a cooking appliance that heats food utilizing the property of an electromagnetic wave called a microwave.

The microwave oven generates heat from the inside of food by the dielectric heating method to heat the food. When an electromagnetic wave having a high frequency collides with food, water molecules inside the food are rotated, so that the molecular arrangement of the food is in disorder. As such, the microwave oven heats food utilizing heat generated by the rotation of water molecules.

Generally, the microwave oven includes a main body forming an outer appearance and having a cooking chamber into which food to be cooked is introduced through an opened front surface of the main body, and a door mounted on the opened front surface to selectively open and close the cooking chamber.

In order to put food into the cooking chamber or to take the cooked food out of the cooking chamber, it is necessary to open and close the door and reduce the noise generated when the door is closed.

SUMMARY

Therefore, it is an aspect of the disclosure to provide a cooking appliance capable of reducing noise generated when a door is closed using a buffer member that is easily fixed to a hinge unit.

In accordance with an aspect of the disclosure, a cooking appliance includes a main body, a cooking chamber provided to have a front surface opened inside the main body, a door to open and close the cooking chamber, a hinge unit coupled to the main body to rotatably support the door, and a buffer member fixed to the door to buffer an impact generated when the door is closed by contacting the hinge unit when the door is closed.

The buffer member may include a fixing hook fixed to the door, and a buffer part to buffer the impact by contacting the hinge unit when the door is closed.

The hinge unit may include a first coupling part coupled to the main body, a second coupling part coupled to the door, and a hinge part having one side coupled to the first coupling part and the other side on which a hinge shaft is provided to allow the second coupling part to be rotatably coupled to the hinge shaft.

The buffer member may be fixed to the second coupling part, and the second coupling part may include a fixing hole to which the fixing hook is fixed.

The buffer part may include a support portion supported on the second coupling part, and a contact portion extending from the support portion to buffer the impact by contacting the hinge part when the door is closed.

The contact portion may be provided to be bent at an angle of 90 degrees or less with respect to the support portion.

The contact portion may be provided to be bent at an angle of approximately 15 degrees with respect to the support portion.

The buffer part may be provided to have a length of approximately 15 mm in the vertical direction.

A plurality of the fixing hooks may be provided and the number of the fixing holes may correspond to the number of the plurality of fixing hooks.

The buffer part may include a support portion supported on the second coupling part, and contact portions extending in a direction from the left and right ends of the support portion toward the main body to buffer the impact by contacting the hinge part when the door is closed.

The buffer member may be made of a plastic material.

In accordance with another aspect of the disclosure, a cooking appliance includes a main body, a cooking chamber provided to have a front surface opened inside the main body, a door to open and close the cooking chamber, a hinge unit including a first coupling part coupled to the main body, a second coupling part coupled to the door, and a hinge part having one side coupled to the first coupling part and the other side on which a hinge shaft is provided to allow the second coupling part to be rotatably coupled to the hinge shaft, and a buffer member fixed to the second coupling part to buffer an impact by contacting the hinge part when the door is closed.

The buffer member may include a fixing hook fixed to the door, and a buffer part to buffer the impact by contacting the hinge unit when the door is closed.

The buffer part may include a support portion supported on the second coupling part, and a contact portion extending from the support portion to buffer the impact by contacting the hinge part when the door is closed.

The buffer part may include a support portion supported on the second coupling part, and contact portions extending in a direction from the left and right ends of the support portion toward the main body to buffer the impact by contacting the hinge part when the door is closed.

According to embodiments of the disclosure, the manufacturing costs can be reduced, and the noise generated when a door is closed can be reduced by using a buffer member capable of being easily fixed.

DETAILED DESCRIPTION OF THE DRAWINGS

DETAILED DESCRIPTION

Figure 1:
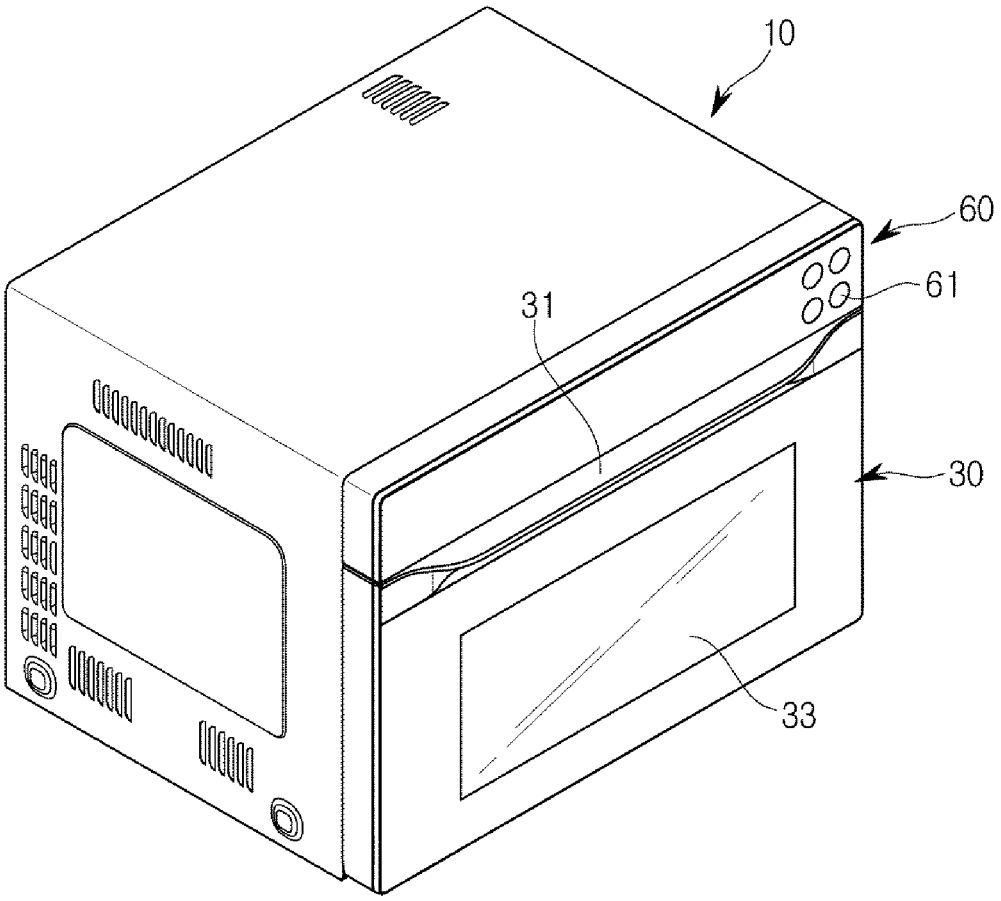
FIG. 1 is a perspective view illustrating an outer appearance of a cooking appliance according to an embodiment of the disclosure.

The embodiments described in the present specification and the configurations shown in the drawings are only examples of preferred embodiments of the disclosure, and various modifications may be made at the time of filing of the disclosure to replace the embodiments and drawings of the present specification.

Like reference numbers or signs in the respective drawings of the present specification represent parts or components that perform substantially the same functions.

The terms used in the present specification are for the purpose of describing the embodiments and are not intended to restrict and/or to limit the disclosure. For example, the singular expressions herein may include plural expressions, unless the context clearly dictates otherwise. Also, the terms "comprises" and "has" are intended to indicate that there are features, numbers, steps, operations, elements, parts, or combinations thereof described in the specification, and do not exclude the presence or addition of one or more other features, numbers, steps, operations, elements, parts, or combinations thereof.

It will be understood that, although the terms first, second, etc. may be used herein to describe various components, these components should not be limited by these terms. These terms are only used to distinguish one component from another. For example, without departing from the scope of the disclosure, the first component may be referred to as a second component, and similarly, the second component may also be referred to as a first component. The term "and/or" includes any combination of a plurality of related items or any one of a plurality of related items.

The terms "front end," "rear end," "upper portion," "lower portion," "upper end" and "lower end" used in the following description are defined with reference to the drawings, and the shape and position of each component are not limited by these terms.

Hereinafter, embodiments of the disclosure will be described in detail with reference to the accompanying drawings.

Figure 2:
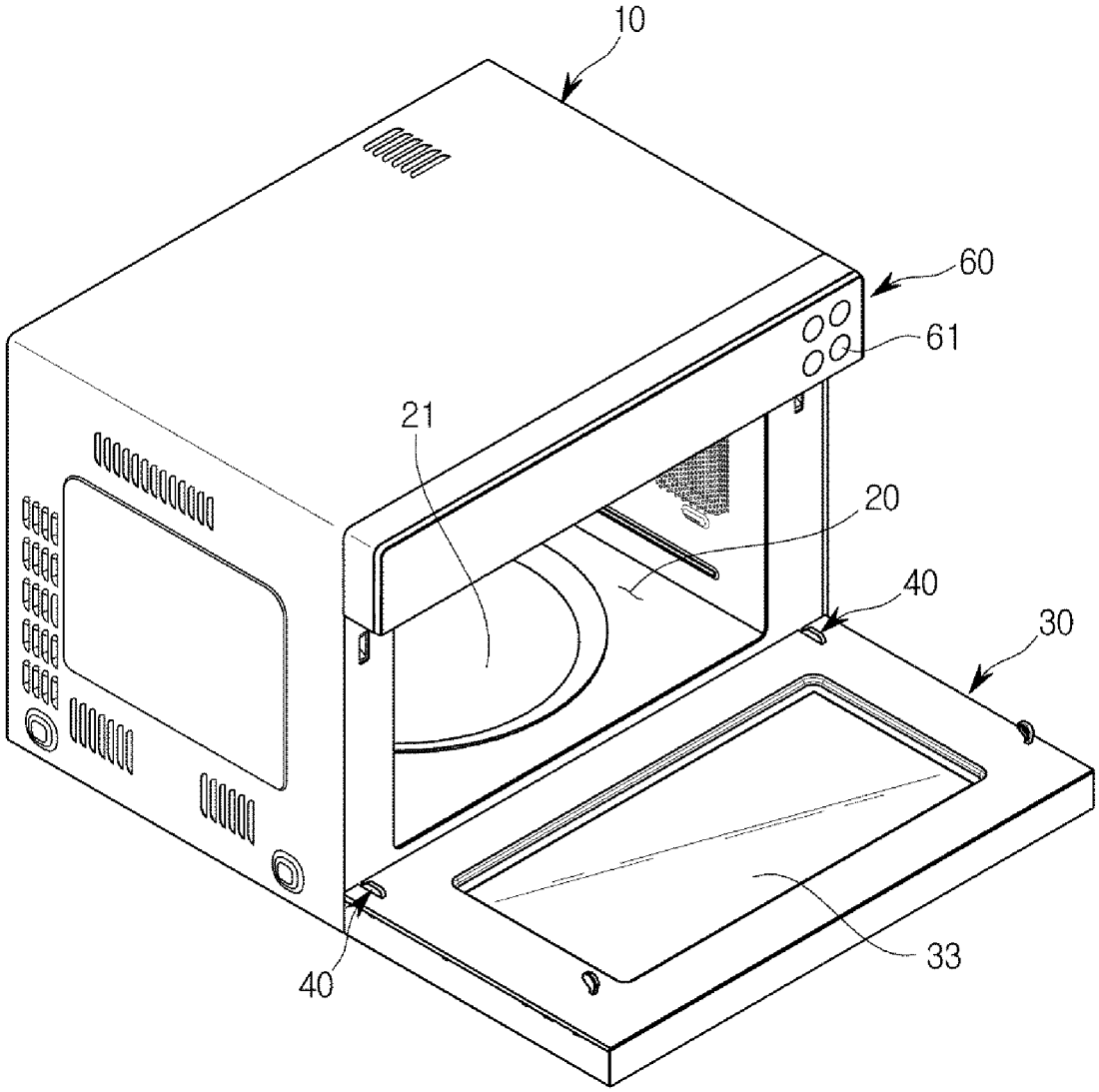
FIG. 2 is a perspective view illustrating a state in which a door is completely opened in the cooking appliance according to an embodiment of the disclosure.
Figure 3:
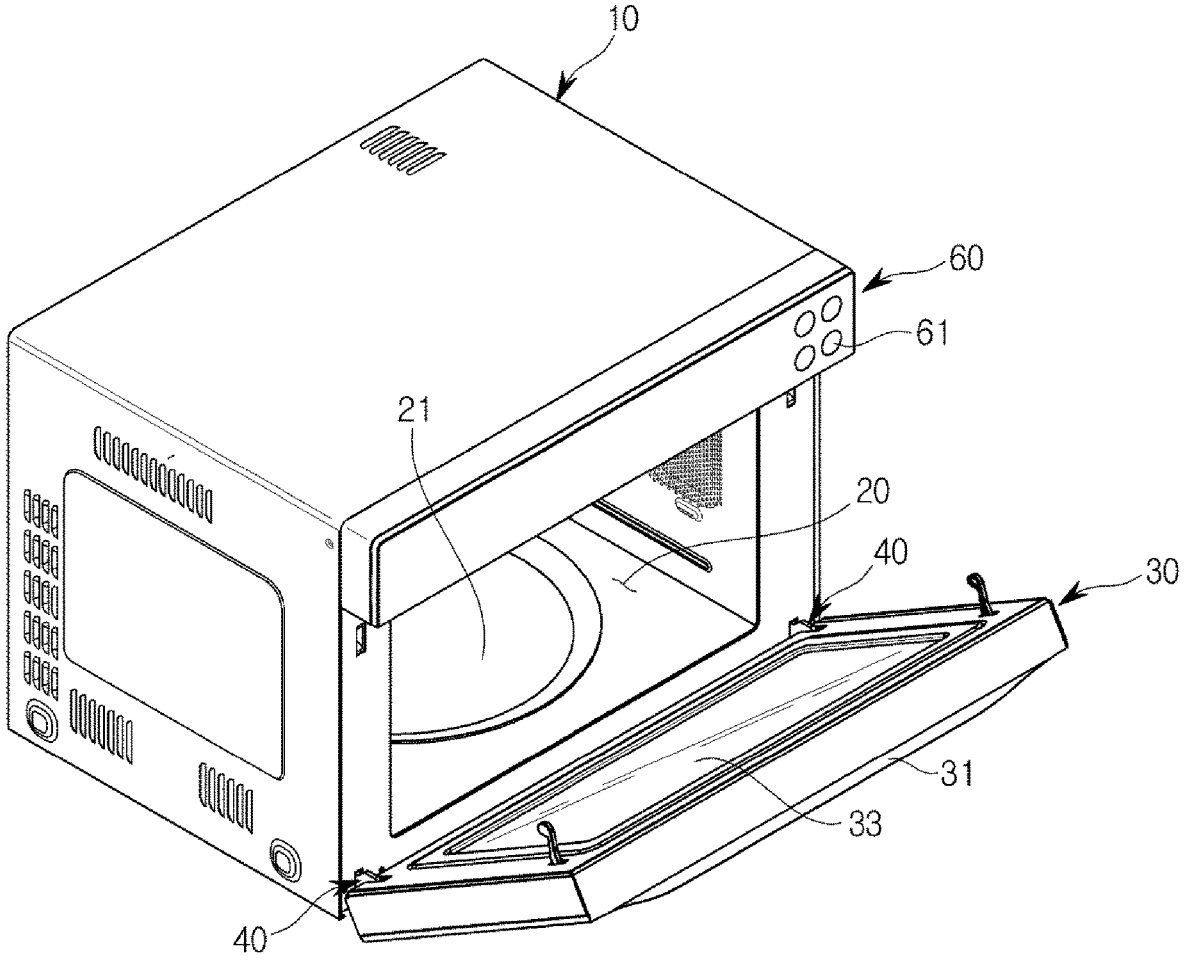
FIG. 3 is a perspective view illustrating a state in which the door is partially closed in the cooking appliance according to an embodiment of the disclosure.
Figure 4:
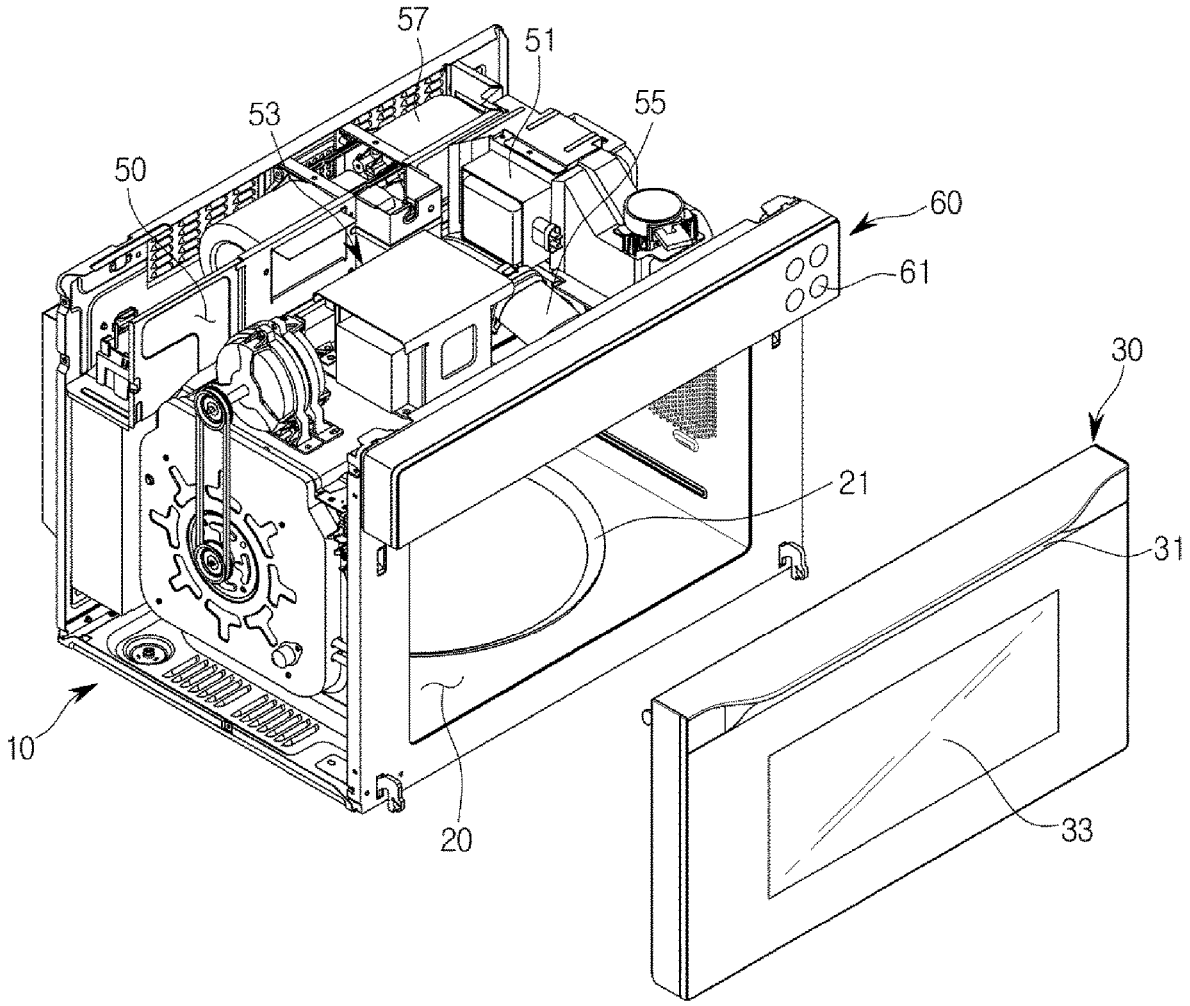
FIG. 4 is a view illustrating the inside of a main body of the cooking appliance according to an embodiment of the disclosure.

FIG. 1 is a perspective view illustrating an outer appearance of a cooking appliance according to an embodiment of the disclosure, FIG. 2 is a perspective view illustrating a state in which a door is completely opened in the cooking appliance according to an embodiment of the disclosure, FIG. 3 is a perspective view illustrating a state in which the door is partially closed in the cooking appliance according to an embodiment of the disclosure, and FIG. 4 is a view illustrating the inside of a main body of the cooking appliance according to an embodiment of the disclosure.

As illustrated in FIGS. 1 to 4, a cooking appliance includes a main body 10 forming an outer appearance and a cooking chamber 20 provided inside the main body 10 to form a space for cooking food.

Hereinafter, for convenience of description, the direction in which a door 30 is installed with respect to the main body 10 of the cooking appliance is defined as the front direction.

The cooking chamber 20 may be provided to have a front surface opened inside the main body 10 and may be opened and closed by the door 30 rotatably mounted on the opened front surface of the main body 10.

A tray 21 on which food to be cooked is placed may be provided inside the cooking chamber 20. The tray 21 may be connected to a driving member (not shown) provided outside the cooking chamber 20 and rotated by the driving force generated by the driving member. A heater 23 may be provided inside the cooking chamber 20 to generate radiant heat to cook food.

The door 30 may include a handle 31 provided on an upper portion of a front surface of the door 30 so that a user may open and close the door 30, and a see-through window 33 through which the user may see the inside of the cooking chamber 20 to check a cooking state of the food while the door 30 is closed. The door 30 may be rotatably coupled to the front surface of the main body 10 by a hinge unit 40. The hinge unit 40 will be described in detail later.

An electrical component chamber 50 in which electrical components for operating the cooking appliance are installed may be provided above the cooking chamber 20 in the main body 10. A magnetron 51 for generating microwaves may be provided in the electrical component chamber 50, and the microwaves generated by the magnetron 51 may be irradiated into the cooking chamber 20. The electrical component chamber 50 may be provided with a high-voltage transformer (HVT) 53, a high-voltage condenser 55, a high-voltage diode (not shown), a noise filter 57, and the like that constitute a driving circuit for driving the magnetron 51. A cooling fan (not shown) for blowing air inside the electrical component chamber 50 to the outside of the cooking appliance may be disposed in the electrical component chamber 50. The cooling fan may move the heat generated from the electrical components such as the magnetron 51, the high-voltage transformer 53, and the high-voltage condenser 55 provided inside the electrical component chamber 50 to the outside of the cooking appliance.

A control panel 60 covering an opened front surface of the electrical component chamber 50 and capable of operating the electrical components provided in the electrical component chamber 50 may be provided on an upper portion of the front surface of the main body 10. The control panel 60 may include an input 61 and a display (not shown). The input 61 may be provided for the user to input commands for operations such as a cooking function, a cooking mode, a cooking time, and the like of the cooking appliance. The display may be provided to display the conditions set by the user and the operation states and the like using characters, numbers, and symbols.

Figure 5:
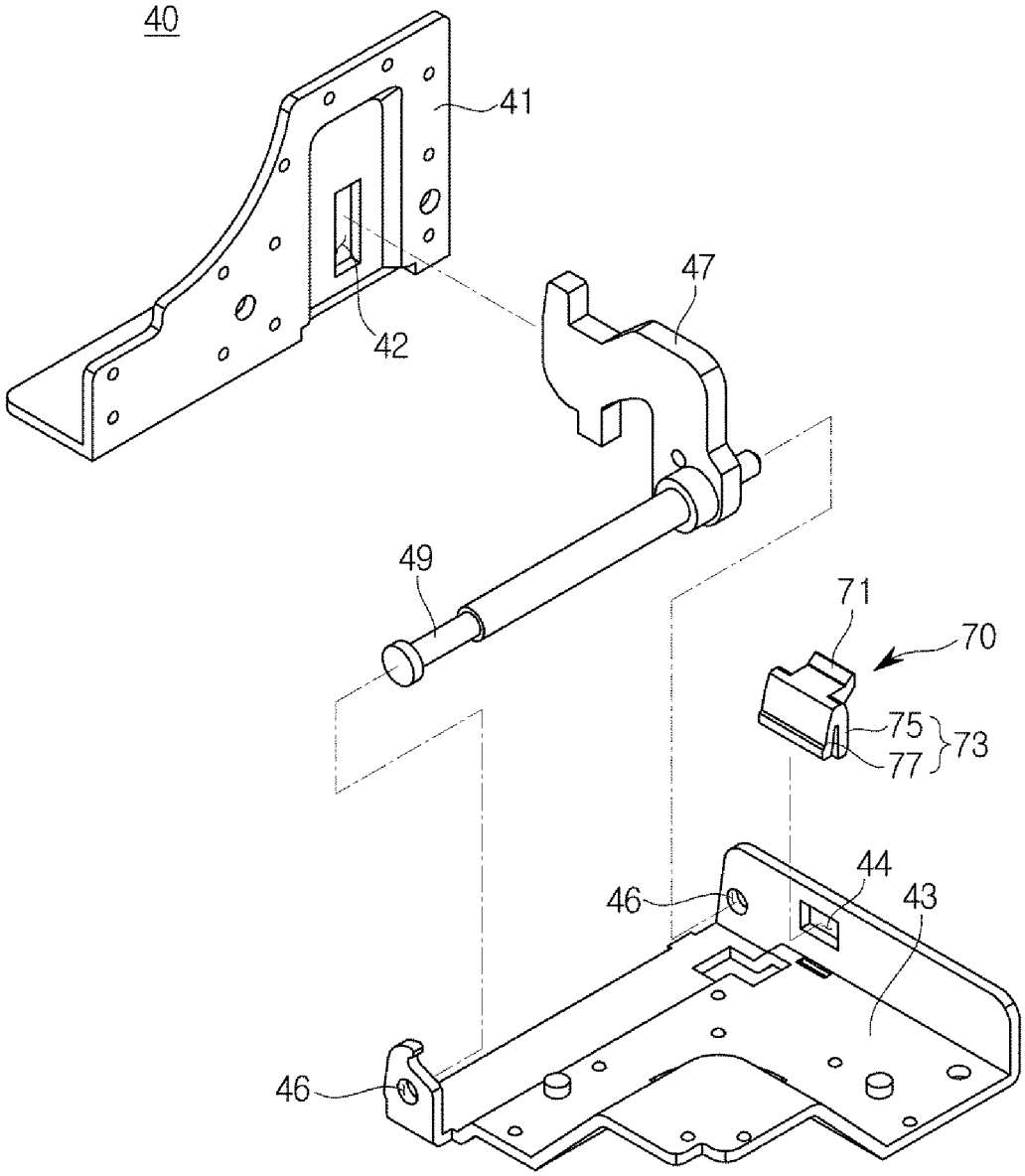
FIG. 5 is an exploded perspective view of a hinge unit according to an embodiment of the disclosure.
Figure 6:
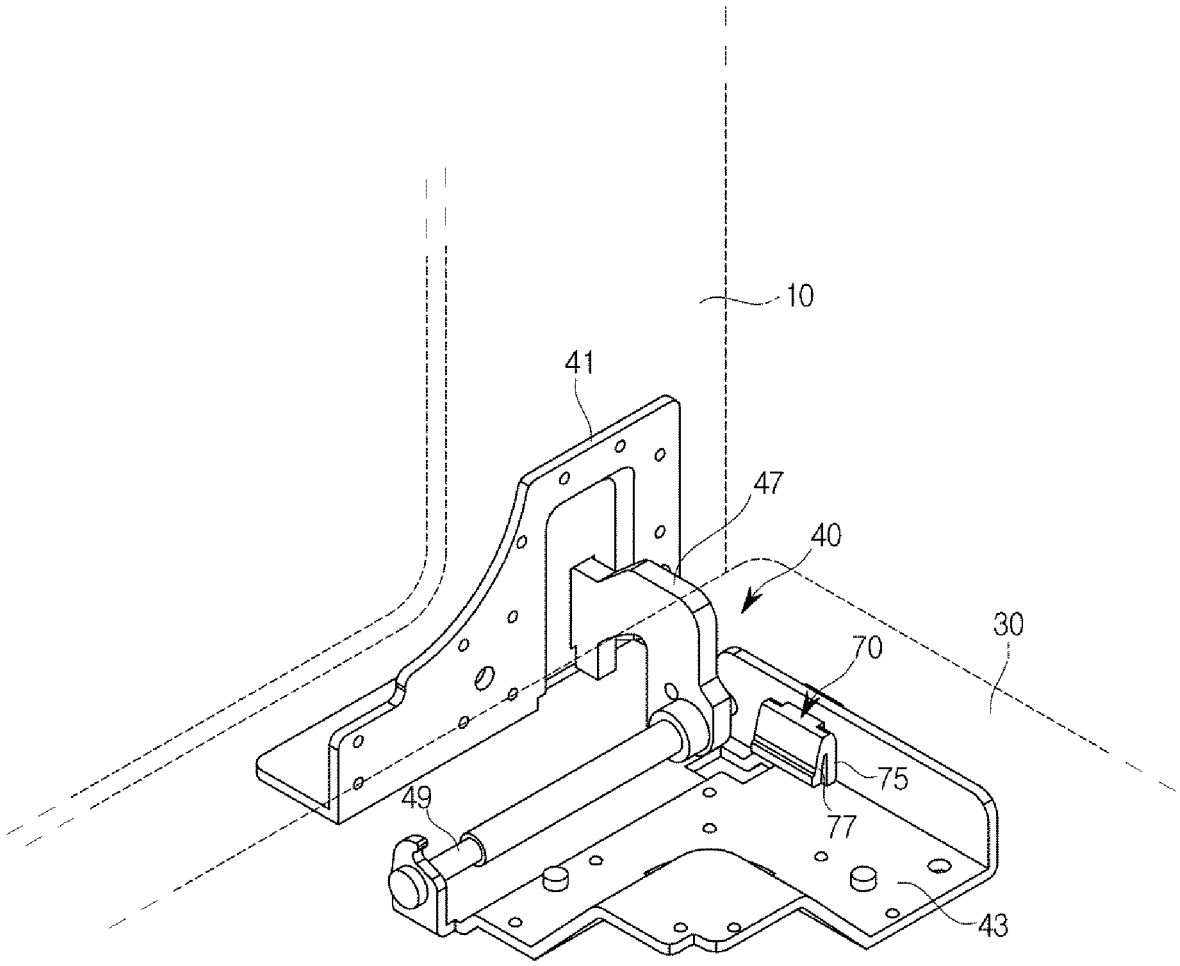
FIG. 6 is a view illustrating the hinge unit when the door of the cooking appliance according to an embodiment of the disclosure is completely opened.
Figure 7:
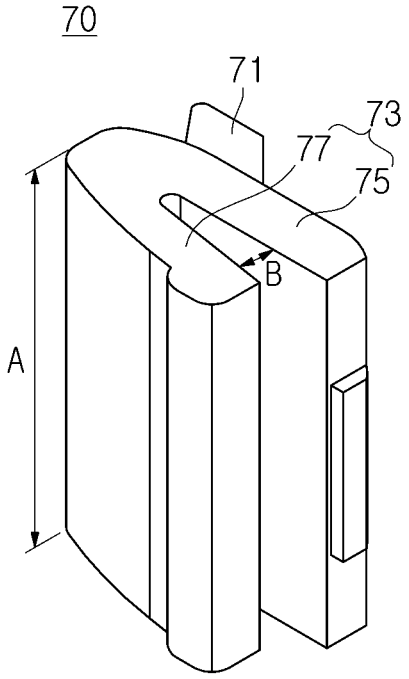
FIG. 7 is a view illustrating a buffer member according to an embodiment of the disclosure.
Figure 8:
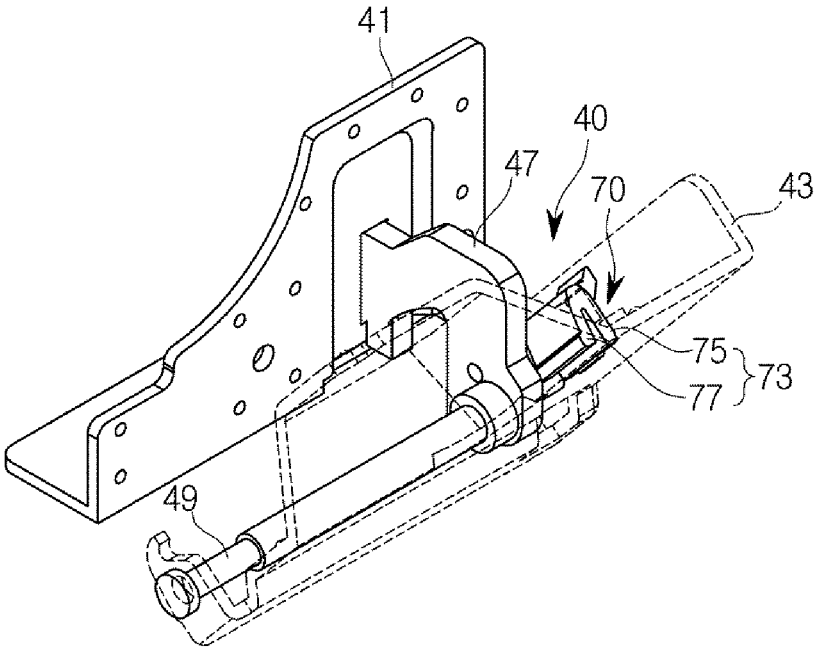
FIG. 8 is a view illustrating the hinge unit when the door of the cooking appliance according to an embodiment of the disclosure is partially closed.
Figure 9:
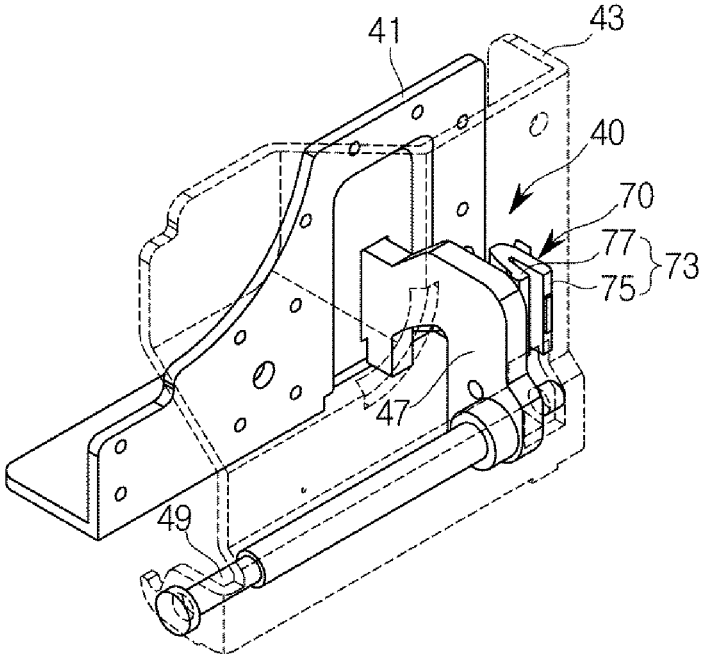
FIG. 9 is a view illustrating the hinge unit when the door of the cooking appliance according to an embodiment of the disclosure is completely closed.

FIG. 5 is an exploded perspective view of a hinge unit according to an embodiment of the disclosure, FIG. 6 is a view illustrating the hinge unit when the door of the cooking appliance according to an embodiment of the disclosure is completely opened, FIG. 7 is a view illustrating a buffer member according to an embodiment of the disclosure, FIG. 8 is a view illustrating the hinge unit when the door of the cooking appliance according to an embodiment of the disclosure is partially closed, and FIG. 9 is a view illustrating the hinge unit when the door of the cooking appliance according to an embodiment of the disclosure is completely closed.

As illustrated in FIGS. 5 and 6, the hinge unit 40 to allow the door 30 to be rotatably coupled to the main body 10 may include a first coupling part 41 coupled to the main body 10, a second coupling part 43 coupled to the door 30, and a hinge part 47 having one side coupled to the first coupling part 41 and the other side on which a hinge shaft 49 is provided.

The first coupling part 41 is coupled to the main body 10 by fastening members (not shown) and includes a coupling hole 42 to which the one side of the hinge part 47 is coupled. The second coupling part 43 is coupled to the door 30 by fastening members (not shown) and includes a fixing hole 44 to which a buffer member 70, which will be described later, is fixed, and a hinge hole 46 in which the hinge shaft 49 is fitted so that the second coupling part 43 is rotatable with respect to the hinge shaft 49. The one side of the hinge part 47 is coupled to the coupling hole 42 of the first coupling part 41 and the hinge shaft 49 is provided on the other side of the hinge part 47. The hinge shaft 49 is rotatably fitted in the hinge hole 46 of the second coupling part 43 so that the door 30 to which the second coupling part 43 is coupled may be rotatably coupled to the main body 10.

The buffer member 70 that is coupled to the second coupling part 43 buffers an impact generated when the door 30 is closed so that the noise due to the impact is reduced.

The buffer member 70 may be made of a plastic material, and may include a fixing hook 71 fitted in and fixed to the fixing hole 44 of the second coupling part 43 and a buffer part 73 to buffer an impact by contacting the hinge part 47 of the hinge unit 40 when the door 30 is closed. The buffer member 70 is preferably made of a plastic material, but may be made of a metal material. The buffer part 73 may include a support portion 75 supported on the second coupling part 43 and a contact portion 77 extending from the support portion 75 and contacting the hinge part 47 when the door 30 is closed.

As illustrated in FIG. 7, when a length A in the vertical direction is approximately 15 mm, the buffer part 73 may most effectively reduce the noise generated when the door 30 is closed.

The contact portion 77 is provided to be bent from the support portion 75 such that an angle B between the contact portion 77 and the support portion 75 is 90 degrees or less. When the contact portion 77 is bent such that the angle B between the contact portion 77 and the support portion 75 is approximately 15 degrees, the noise generated when the door 30 is closed may be most effectively reduced.

Next, the operation in which the impact generated when the door 30 is closed is buffered by the buffer member 70 will be described.

As illustrated in FIGS. 2 and 6, the buffer member 70 is in a position spaced apart from the hinge part 47 in a state where the door 30 is completely opened.

As illustrated in FIGS. 3 and 8, when the door 30 is partially closed, the contact portion 77 of the buffer member 70 comes into contact with the other side of the hinge part 47.

As illustrated in FIGS. 1 and 9, when the door 30 is completely closed in a state where the contact portion 77 of the buffer member 70 is in contact with the hinge part 47, the impact generated when the door 30 is closed is buffered by the elastic force of the contact portion 77. In addition, because the impact generated when the door 30 is closed is buffered, the noise generated when the door 30 is closed is also reduced.

Figure 10:
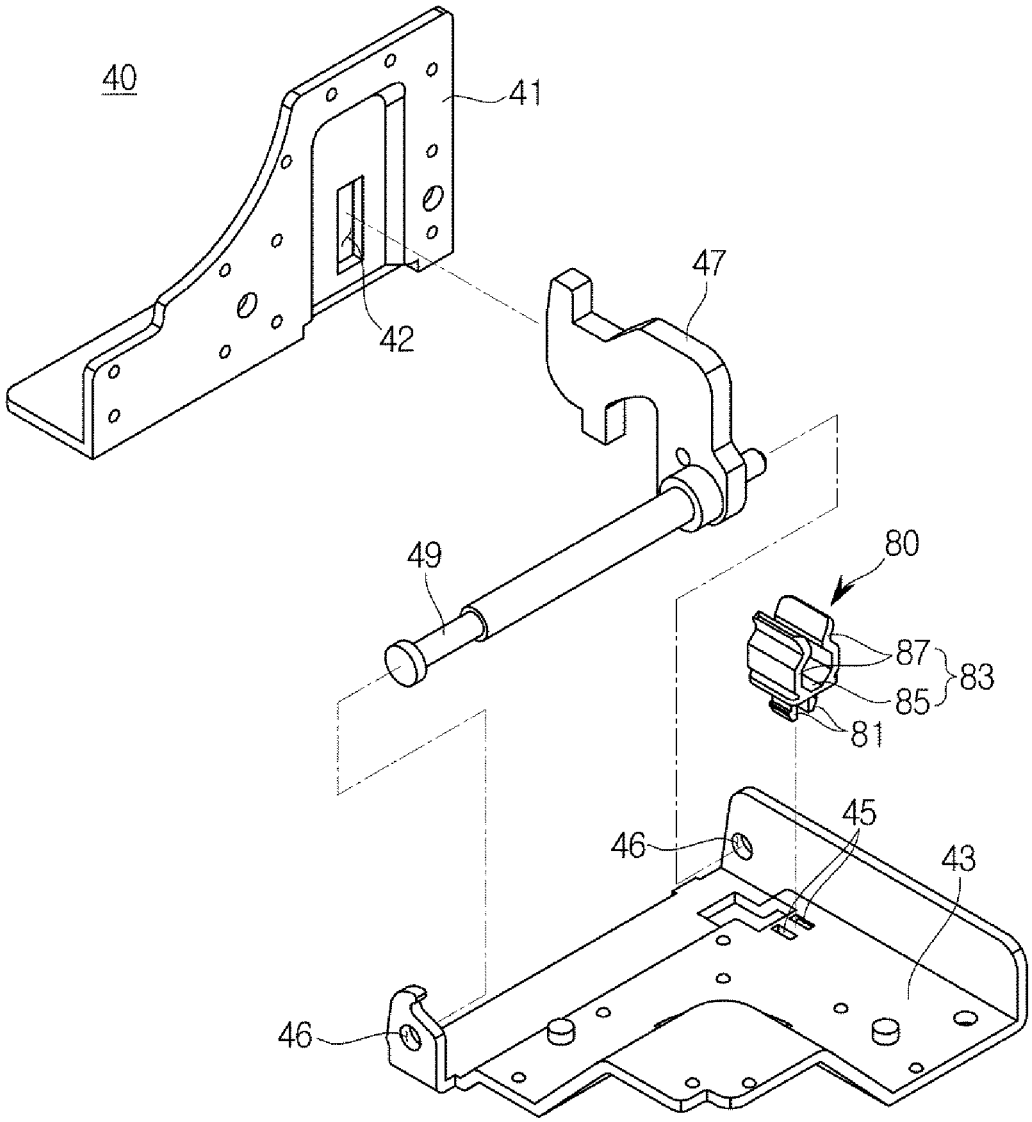
FIG. 10 is an exploded perspective view of a hinge unit according to another embodiment of the disclosure.
Figure 11:
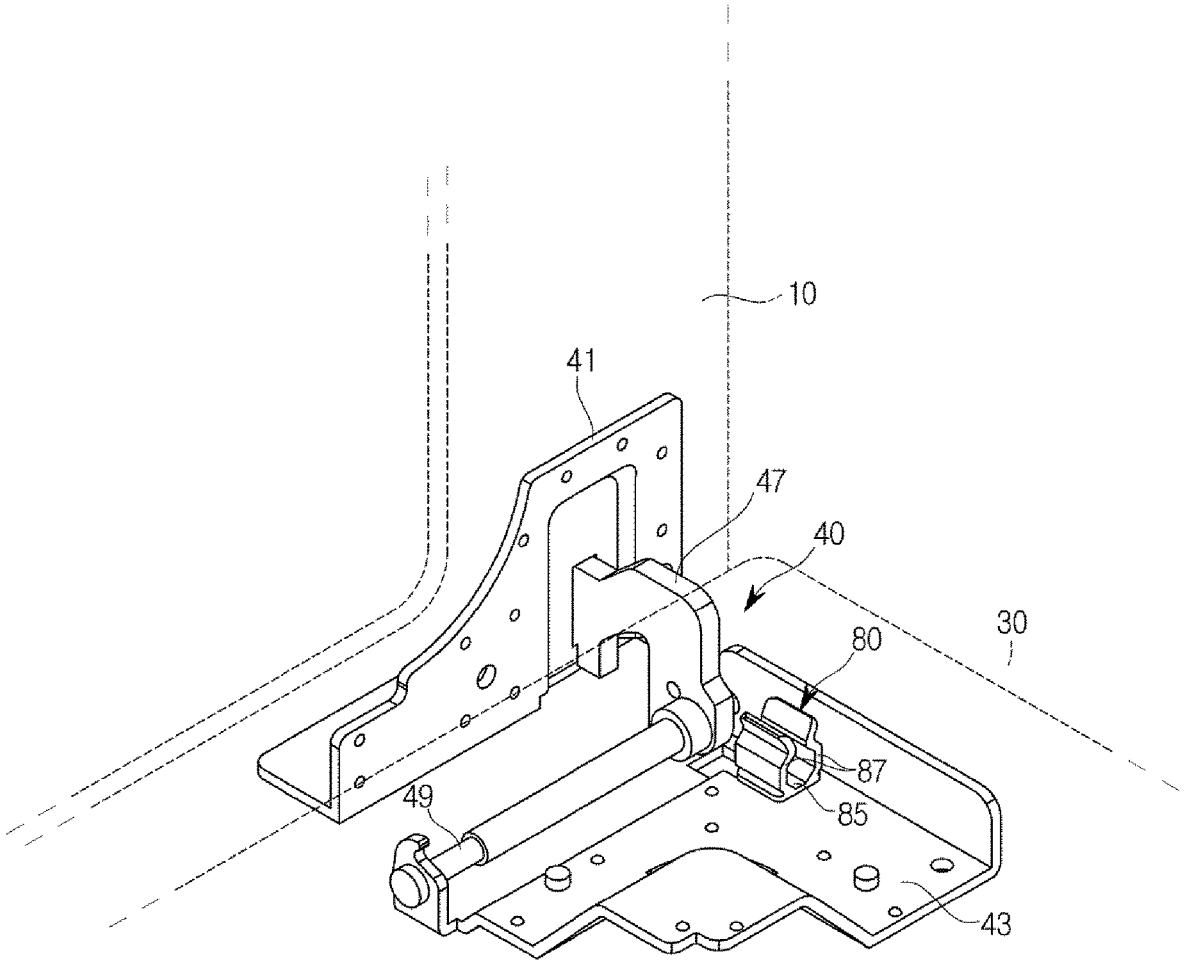
FIG. 11 is a view illustrating the hinge unit when a door of a cooking appliance according to another embodiment of the disclosure is completely opened.
Figure 12:
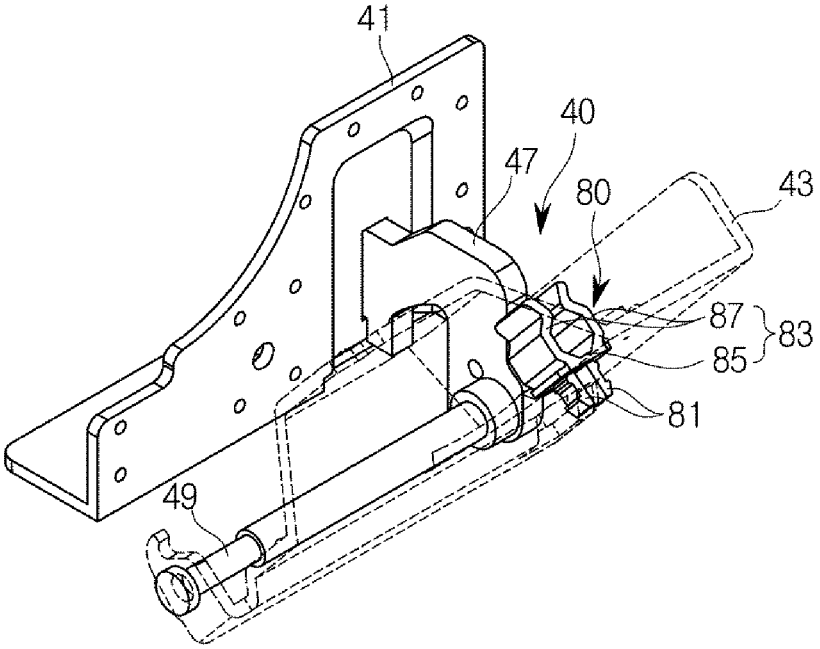
FIG. 12 is a view illustrating the hinge unit when the door of the cooking appliance according to another embodiment of the disclosure is partially closed.
Figure 13:
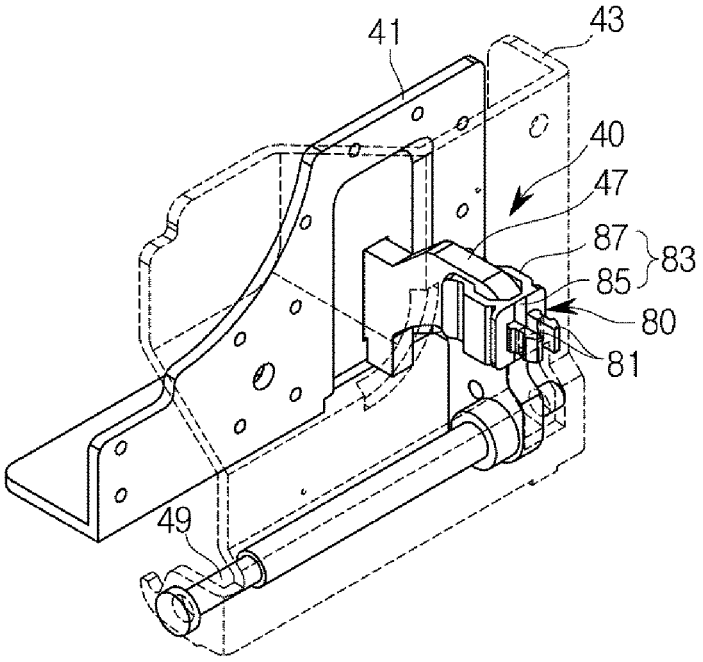
FIG. 13 is a view illustrating the hinge unit when the door of the cooking appliance according to another embodiment of the disclosure is completely closed.

FIG. 10 is an exploded perspective view of a hinge unit according to another embodiment of the disclosure, FIG. 11 is a view illustrating the hinge unit when a door of a cooking appliance according to another embodiment of the disclosure is completely opened, FIG. 12 is a view illustrating the hinge unit when the door of the cooking appliance according to another embodiment of the disclosure is partially closed, and FIG. 13 is a view illustrating the hinge unit when the door of the cooking appliance according to another embodiment of the disclosure is completely closed.

As illustrated in FIGS. 10 and 11, the configuration of the hinge unit 40, which includes the first coupling part 41, the second coupling part 43 and the hinge part 47 to allow the door 30 to be rotatably coupled to the main body 10, is the same as that of the hinge unit 40 illustrated in FIGS. 5 and 6, and thus a description for the above configuration will be omitted. However, because a buffer member 80 fixed to the hinge unit 40 is different from the buffer member 70 illustrated in FIGS. 5 and 6, only the configuration related thereto will be described.

The buffer member 80 may be made of a plastic material, and may include a pair of fixing hooks 81 fitted in and fixed to a pair of fixing holes 45 provided on the second coupling part 43, and a buffer part 83 to buffer an impact by contacting the hinge part 47 of the hinge unit 40 when the door 30 is closed. The buffer member 80 is preferably made of a plastic material, but may be made of a metal material. The buffer part 83 may include a support portion 85 supported on the second coupling part 43 and a pair of contact portions 87 extending from opposite ends of the support portion 75 and contacting the hinge part 47 when the door 30 is closed.

Next, the operation in which the impact generated when the door 30 is closed is buffered by the buffer member 80 will be described.

As illustrated in FIGS. 2 and 11, the buffer member 80 is in a position spaced apart from the hinge part 47 in a state where the door 30 is completely opened.

As illustrated in FIGS. 3 and 12, when the door 30 is partially closed, the pair of contact portions 87 of the buffer member 80 come into contact with the other side of the hinge part 47.

As illustrated in FIGS. 1 and 13, when the door 30 is completely closed in a state where the pair of contact portions 87 are in contact with the hinge part 47, the impact generated when the door 30 is closed is buffered by the elastic force of the contact portions 87 while the hinge part 47 is inserted between the pair of contact portions 87. In addition, because the impact generated when the door 30 is closed is buffered, the noise generated when the door 30 is closed is also reduced.

While the preferred embodiments of the disclosure have been disclosed for illustrative purposes, those skilled in the art will appreciate that various modifications, additions and substitutions are possible, without departing from the scope and spirit of the disclosure as disclosed in the accompanying claims.

The invention claimed is:

1. A cooking appliance comprising:

a main body;

a cooking chamber provided to have a front surface opened inside the main body;

a door to open and close the cooking chamber;

a hinge unit coupled to the main body to rotatably support the door, wherein the hinge unit includes:

a first coupling part coupled to the main body, a second coupling part coupled to the door and including a fixing hole, and a hinge part having a side coupled to the first coupling part and another side on which a hinge shaft is provided to allow the second coupling part to be rotatably coupled to the hinge shaft; and a buffer member including a fixing hook fixed to the fixing hole of the second coupling part and a buffer part to buffer an impact generated when the door is closed by contacting the hinge unit when the door is closed.

2. The cooking appliance according to claim 1, wherein the buffer part includes:

a support portion supported on the second coupling part, and a contact portion extending from the support portion to buffer the impact by contacting the hinge part when the door is closed.

3. The cooking appliance according to claim 2, wherein the contact portion is provided to be bent at an angle of 90 degrees or less with respect to the support portion.

4. The cooking appliance according to claim 3, wherein the contact portion is provided to be bent at an angle of approximately 15 degrees with respect to the support portion.

5. The cooking appliance according to claim 1, wherein the buffer part is provided to have a length of approximately 15 mm in a vertical direction.

6. The cooking appliance according to claim 1, wherein:

a plurality of fixing hooks are provided, and a number of fixing holes corresponds to a number of the plurality of fixing hooks.

7. The cooking appliance according to claim 6, wherein the buffer part includes:

a support portion supported on the second coupling part, and contact portions extending in a direction from left and right ends of the support portion toward the main body to buffer the impact by contacting the hinge part when the door is closed.

8. The cooking appliance according to claim 1, wherein the buffer member is made of a plastic material.

* * * * *